United States Patent [19]

Peterson

[11] 4,176,579

[45] Dec. 4, 1979

[54] CIRCUIT FOR SIMULATING REVERBERATION IN ELECTRONIC ORGANS

[76] Inventor: Richard H. Peterson, 11748 Walnut Ridge Dr., Palos Park, Ill. 60464

[21] Appl. No.: 800,109

[22] Filed: May 24, 1977

[51] Int. Cl.[2] ..... G10H 1/02

[52] U.S. Cl. ..... 84/1.24; 84/1.13

[58] Field of Search ..... 84/1.13, 1.24, 1.26, 84/DIG. 4, 16, 23, 26

[56] References Cited

U.S. PATENT DOCUMENTS

| | | | |
|---|---|---|---|
| 3,557,297 | 1/1971 | Matsuura | 84/1.26 |
| 3,591,702 | 7/1971 | Adachi | 84/1.26 |
| 3,651,730 | 3/1972 | Adachi | 84/1.26 |
| 3,861,263 | 1/1975 | Okudaira | 84/1.26 |
| 3,924,505 | 12/1975 | Schrelongost | 84/1.26 |
| 3,971,284 | 7/1976 | Schreier | 84/1.24 |
| 4,014,238 | 3/1977 | Southard | 84/1.26 |

*Primary Examiner*—Gene Z. Rubinson
*Assistant Examiner*—Leonard W. Pojunas, Jr.
*Attorney, Agent, or Firm*—Spencer E. Olson

[57] ABSTRACT

In an electronic organ system having a plurality of tone generators one for each note to be sounded, and a time constant circuit for establishing first and second decay characteristics for each note, the first of which has a longer decay period than the second, a key-down detector for sensing the operated condition of any key of the keyboard, and a circuit operative in response to the key-down detector to cause the sounded notes to have the longer decay characteristic so long as any key of the keyboard is depressed and to cause the sounded notes to have the shorter decay characteristic when all keys are released, for producing a pseudo-reverberation effect.

4 Claims, 2 Drawing Figures

CIRCUIT FOR SIMULATING REVERBERATION IN ELECTRONIC ORGANS

BACKGROUND OF THE INVENTION

This invention relates to electronic musical instruments, and, more particularly, to an automatic sustain control circuit for producing a pseudo-reverberation effect in electronic organs.

Reverberatinon effects have been achieved in electronic organs in a variety of ways, a common reverberation device including one or more elongated coil springs having an input signal transducer connected at one end thereof to which electrical musical signals to be reverberated are applied, and an output transducer at the other end for converting distortion of the spring caused by the signal back into an electrical signal which is amplified and acoustically reproduced along with the original main signal, either in a common speaker or in a separate reproducing channel. Such devices, although producing a useful reverberation effect, are bulky and difficult to package in the console of electronic organs, and are incapable of reproducing the reverberation effect of a real room, for example.

Also known are reverberation devices utilizing recording and delayed playback of electrical signals corresponding to the music to be reverberated. Such devices, which may utilize a loop of tape and spaced recording and playback heads to achieve the desired delay, produce reasonably acceptable reverberation effects, but they tend to be relatively expensive and to have unacceptable reliability due to wear of the tape and heads.

It is also known that by providing the electronic organ with circuitry that causes the played notes of the organ to have a relatively long decay envelope, an effect that is not unlike reverberation is produced, particularly if the organist plays in a legato manner, namely, smooth and flowing, with unbroken transitions between successive notes, and which in some respects is superior to the reverberation effect achieved with the described spring devices in that it does not have the raggedness in frequency response that characterizes all spring units. However, most electronic organs in use today employ continuously operating tone generators to produce signals corresponding to the various notes of the scale, with each individual tone generator connected to a gating circuit operated in response to application of a DC voltage from the keyboard; that is, when a key is depressed the DC voltage is applied to the associated gating circuit which connects the corresponding tone to the output system of the organ, usually by way of various filters and stop control devices. The gating circuit includes a resistor that determines the attack characteristic and a capacitor so connected that when the key switch corresponding to a given note is closed the capacitor is discharged through a resistor with a predetermined time constant; the time constant for regular organ voices is of such a value that gating occurs with a smooth rise and fall of the intensity at the output of the gate, but without any appreciable sustain characteristic. If, on the other hand, it is desired to simulate chimes or bells, or other percussion instruments, it is known to employ a short attack time constant and a long decay time constant; that is, the capacitor connected to the keying terminal charges quickly and discharges slowly, allowing the tone to build rather quickly, but without a click, and to stay at that level as long as the key is depressed and to decay, upon release of the key, with a generally logarithmic decay curve.

When the just-described long decay time constant is used, and the organ is played in a legato manner, a pseudo-reverberation effect, due to the intermingling of the sounds as one note is played and then released and another note is sounded, results; the sounds intermingle in much the same way as they would in a "live" room in which reverberation causes the notes to continue sounding for a period of time after the keys causing those notes to sound are released. The illusion of real or natural reverberation tends to be destroyed upon release of all played keys, the decay characteristic under such conditions sounding more like the decay characteristic of a percussion instrument.

It is a primary object of the present invention to avoid the described shortcomings of the prior art and to provide means for more effectively using the sustain characteristic to produce an improved pseudo-reverberation effect at very low cost.

SUMMARY OF THE INVENTION

Briefly, this and other objects of the invention which will become apparent as the description proceeds, are achieved in an electronic organ system including a plurality of tone generators one for each note to be sounded, a gating circuit for each note, and a time constant circuit associated with each gate for determining the attack and decay characteristics of the signal transmitted by the gating circuit, by a circuit including a key-down detector connected to be operative in response to the depression of any key on the keyboard to cause the sounded notes to have a relatively long decay characteristic so long as any key is depressed, and to cause the sounded notes to have a shorter decay characteristic when all keys of the organ are released.

DESCRIPTION OF THE DRAWINGS

Other objects, features and advantages of the invention will become apparent, and its construction and operation better understood, from the following detailed description taken in conjunction with the accompanying drawings, in which.

DESCRIPTION OF THE PREFERRED EMBODIMENT

Figure 1:
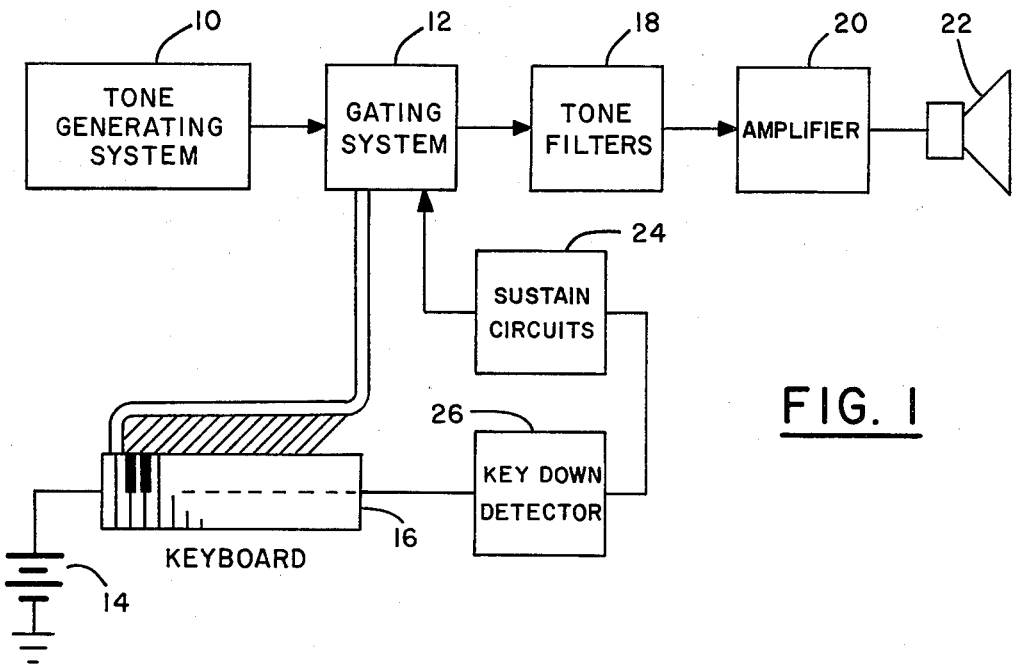
FIG. 1 is a block diagram of an organ system, illustrating the connection therein of the present invention.

The present invention has utility in known organ systems, shown in block diagram form in FIG. 1, which utilize as a primary source of tone signals a tone generating system 10 for producing signals of square waveform having frequencies corresponding to the notes of a musical scale. Each tone generator, one for each note of the instrument, is connected to a respective gate, all of which are included in the schematically illustrated gating system 12, which is actuated by a DC potential from a source 14 in response to depression of a corresponding key on a keyboard 16. The gating system 12 couples the played notes through various tone filters 18 and stop control devices to an amplification system 20 for acoustical reproduction by a loudspeaker 22. Each of the gating circuits has a sustain circuit associated therewith, all of which are collectively shown by the block 24, which includes a time constant circuit which controls the attack and decay characteristics of the square wave signal transmitted by the gating circuit. An important feature of the present invention is the provision of a key-down detector 26, operative in response to the depression of any key on the keyboard 16 and connected to control the decay characteristic of the time constant circuit of all of the gating circuits.

Figure 2:
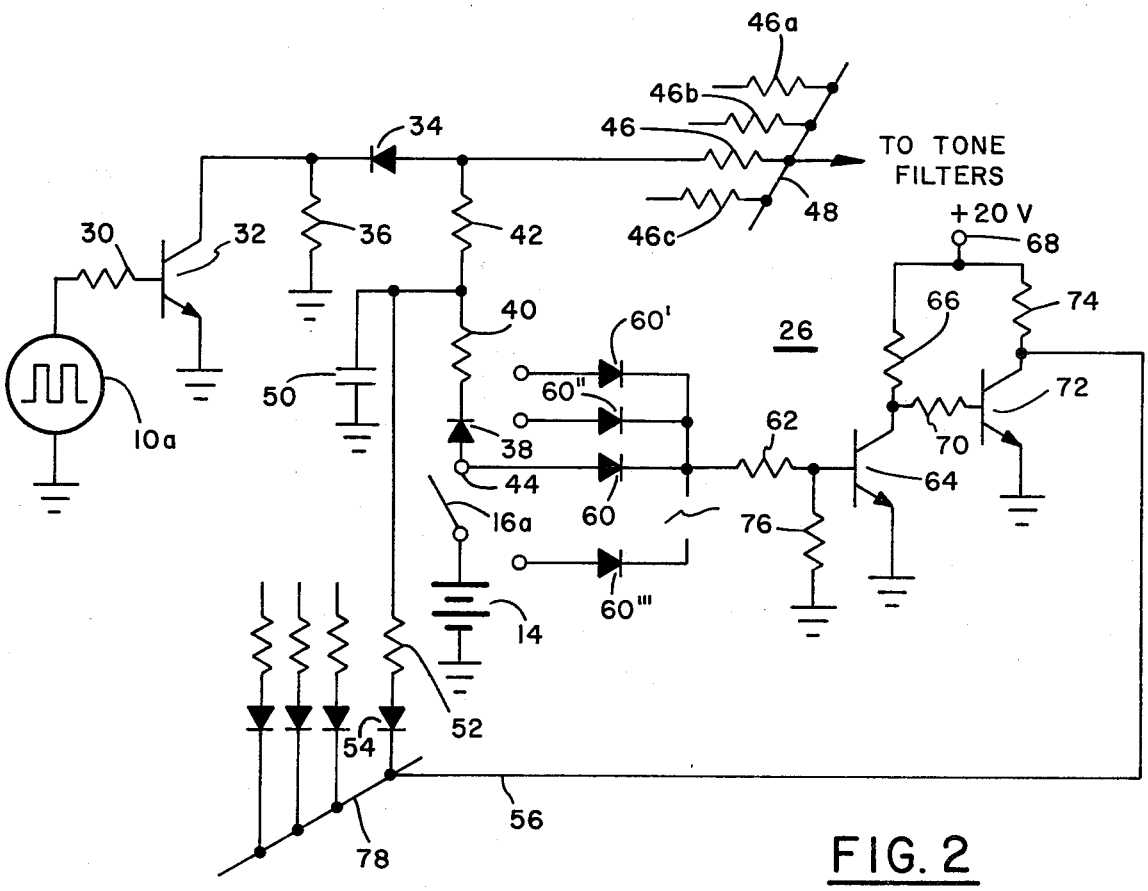
FIG. 2 is a schematic circuit diagram of one embodiment of a control circuit according to the invention for automatically changing the decay characteristic of the notes sounded by the organ keys.

Referring now to FIG. 2, an individual tone generator 10*a* of the tone generating system 10 which, by way of example, produces a 50% duty cycle square wave signal, is connected through a resistor 30 to the base electrode of a gating transistor 32, the emitter of which is connected to ground and the collector of which is connected to the cathode of a diode 34 and also through a resistor 36 to ground. Collector voltage for transistor 32 is derived from the keyboard source 14, when a key switch 16*a* is closed, through a diode 38, series-connected resistors 40 and 42, and the diode 34. The circuit is so arranged that when the pulse signal from source 10*a* is at its upper level, transistor 32 saturates thereby connecting the collector to ground through the collector-emitter junction. Thus, the transistor functions as a switch that is alternately opened and closed in accordance with the low and high level, respectively, of the square wave tone signal. When the key corresponding to the note generated by the source 10*a* is depressed to close key switch 16*a*, a potential is applied to the keying terminal 44 of the gate, causing current to flow through resistors 40 and 42 and an additional resistor 46 to an output bus 48, to which resistors 46*a*, 46*b* and 46*c*, corresponding to resistor 46 in additional gate circuits are also connected. The DC keying voltage is shortcircuited to ground at the frequency of tone generator 10*a* by the switching transistor 32 causing a signal to appear at the output bus 48 that is essentially a duplicate of the signal from the tone generator. The attack characteristic of the gated square wave signal is controlled by a capacitor 50 and an attack resistor 40 through which the capacitor is charged when the key switch 16*a* is closed. The decay characteristic of the gated signal is determined by the value of capacitor 50 and the values of resistors 42 and 46.

Automatic control of the decay envelope of the gating circuit, to cause it to be different when the key switch 16*a* is closed than when it is open is provided by the combined action of a key-down detector 26 and an auxiliary discharge path for capacitor 50 which comprises a snubbing resistor 52 and a diode 54 connected in series from the ungrounded terminal of capacitor 50 to a conductor 56. If conductor 56 were connected to a source of potential lower than the voltage of keying source 14, so long as the voltage on conductor 56 is less than the voltage across capacitor 50, the diode 54 conducts and thereby places resistor 52 in parallel with capacitor 50 and provides an auxiliary discharge path, in parallel with the path comprising resistors 42 and 46, thus speeding discharge of the capacitor and shortening the decay envelope. If, on the other hand, conductor 56 is at a floating potential, or is connected to a source of potential having a value higher than the voltage across the envelope capacitor 50 at any instant of time, diode 54 will be biased into non-conduction and the auxiliary discharge path will be disabled.

The auxiliary discharge path is automatically disabled when any key of the keyboard is depressed, and is automatically enabled whenever all keys of the keyboard are released, by a key-down detector which includes a diode 60 whose anode is connected to the keying terminal 44 and whose cathode is connected through a resistor 62 to the base electrode of a transistor 64. The cathode of diodes 60',60'' and 60''', representative of the diodes connected from the keying terminal 44 of all of the other gating circuits of the organ system, are connected together and to the base electrode of transistor 64. The emitter electrode of transistor 64 is grounded, and its collector electrode is connected through a resistor 66 to a source of positive potential, represented by the terminal 68, and also through a resistor 70 to the base electrode of a second transistor 72, the emitter electrode of which is grounded and the collector of which is connected through a resistor 74 to the voltage source 68. The collector electrode of transistor 72 is connected through conductor 56 to the cathode of diode 54. In the absence of a key-down voltage at gating terminal 44, the base of transistor 64 is connected to ground through a resistor 76, thereby holding the transistor non-conducting. Consequently, no current flows in the collector-emitter junction of transistor 64 and the full voltage of the potential source 68, typically 20 volts, appears at the collector electrode of transistor 64. This voltage is applied through resistor 70 to the base electrode of transistor 72, causing the transistor to conduct, thereby connecting the cathode of diode 54 to ground potential through the collector-emitter junction of transistor 72, and enabling the auxiliary discharge path. If, now, the key switch 16*a* is closed, causing the DC potential from source 14 to appear at keying terminal 44, a positive potential is applied to the base electrode of transistor 64 which causes it to conduct and to reduce the voltage at the collector thereof sufficiently to cause transistor 72 to be turned off and its collector voltage to be substantially at the potential of the source 68. This potential is higher than the maximum potential that can be developed across capacitor 50, and accordingly disables the auxiliary discharge path. The collector electrode of transistor 72 is connected to a bus 78 to which the snubbing circuits for all of the other gates of the organ system are connected; thus, only one key-down detector consisting of a pair of transistors 64 and 72 and a plurality of diodes 60, one for each gating circuit, and a like plurality of snubbing circuits, is all that is required for control of the entire organ system.

Thus, when any key is depressed, the sustain circuit, the decay characteristic of which is determined primarily by the values of capacitor 50 and resistors 42 and 46, operates in its normal fashion and produces a pseudo-reverberation effect, particularly when the organ is played in a legato manner. Upon release of all of the keys, the auxiliary discharge path is enabled, thus shortening the sustain decay envelope. The described circuit operation achieves a more realistic reverberation effect than that obtained with only the usual sustain circuits because the objectionable long tail of the decay characteristic is eliminated when all keys are released, yet permits the intermingling of sounds when one goes from one note to another, especially when played in a legato manner.

Although the invention has been described as embodied in a specific type of electronic organ system, the inventive concept is also applicable to musical instruments of the type having a limited number of tone generators and employing key assigning techniques to assign available generators to whatever keys are played at a particular time. Such known systems provide decay envelopes for the sounded notes which have sustain characteristics, the tone generators being designed to remain assigned to their controlling key, even after the key has been released, so that the decay envelope can be completed. The present invention can be readily incorporated in such systems to cause the sounded notes to have a sustain characteristic so long as any key is depressed and to shorten the decay envelope when all of the keys are released.

Also, it is possible to implement the invention in ways other than what has been described. For example, the key-down detector may take a variety of forms and yet accomplish the desired function of enabling the auxiliary discharge path in the absence of a keying potential and disabling the auxiliary discharge path in response to depression of one or more keys and the output circuit of the key-down detector may alternatively be arranged so as to connect the cathode of diode 54 to a potential other than the collector potential of transistor 72 to alter the time during each envelope decay period that diode 54 is conducting so as to create a somewhat different effect than is obtained with the described circuit. Also, the snubbing circuit may take different forms without departing from the spirit of the invention.

I claim:

1. In an electronic organ having a keyboard, and a plurality of tone generators, one for each note to be sounded, a like plurality of time constant circuit means, one associated with each of said notes, for establishing a predetermined first decay characteristic for each note, a key-down detector for sensing the key-down condition of any key of the keyboard, a like plurality of auxiliary circuit means connected one to each of said time constant circuit means and to said key-down detector and operative in response to said key-down detector to cause the sounded notes to have said predetermined first decay characteristic so long as any key of the keyboard is in its key-down position and to cause the sounded notes to have a second decay characteristic having a decay period shorter than the decay period of said first decay characteristic when all keys of the keyboard are in the key-up position.

2. In an electronic organ having a keyboard and a plurality of tone generators one for each note to be sounded, a gating circuit for each of the notes for transmitting a sounded note to acoustic reproducing apparatus, and a time constant circuit associated with each gating circuit for establishing a predetermined decay characteristic for each note transmitted by the gating circuit, apparatus for improving the reverberation effect produced upon playing the organ, said apparatus comprising:

a like plurality of auxiliary discharge circuits connected one to each of said time constant circuits, and circuit means including a key-down detector operative to disable all of said auxiliary discharge circuits so long as any key of the keyboard is in its key-down position, and to enable all of said auxiliary discharge circuits when all of the keys of the keyboard are in the key-up position, said auxiliary discharge circuits when enabled being operative to shorten the decay period of said predetermined decay characteristic.

3. Apparatus according to claim 2, wherein each of said time constant circuits includes a capacitor, wherein individual ones of said gating circuits are actuable by a potential from a DC supply voltage upon depression of a corresponding one of said keys and upon actuation charges the capacitor of the associated time constant circuit to substantially the potential of said supply voltage, wherein each of said auxiliary discharge circuits includes a resistor connectable between one terminal of said capacitor and a second source of voltage having a lower potential than the potential of said DC supply voltage, and wherein said key-down detector is connected to all of the keys of the keyboard and is operative when all keys are in the key-up position to connect all of said auxiliary discharge circuits to said second source of voltage.

4. In an electronic organ having a keyboard, a plurality of tone generators one for each note to be sounded, a like plurality of gating circuits, one for each of said tone generators, for transmitting a sounded note to acoustic reproducing apparatus, and a time constant circuit including a capacitor associated with each gating circuit for establishing a first decay characteristic for the note transmitted by the gating circuit, and wherein individual ones of said gating circuits are actuable by a potential from a DC voltage source upon closure of a corresponding keyswitch of said keyboard and upon actuation charges the capacitor of the associated time constant circuit to substantially the potential of said source voltage, apparatus for improving the reverberation effect produced upon playing the organ, said apparatus comprising:

a like plurality of auxiliary discharge circuits connected one to the capacitor of each of said time constant circuits for establishing, when enabled, a second decay characteristic for a respective note, which second decay characteristic has a shorter decay period than said first decay characteristic, and circuit means connected to all of said auxiliary discharge circuits and including a key-down detector connected to all of said keyswitches operative in response to any key of the keyboard being in its key-down position to disable all of said auxiliary discharge circuits, and operative in response to all of the keys of the keyboard being in the key-up position to enable all of said auxiliary discharge circuits to thereby establish said second decay characteristic.

* * * * *